US005109779A

United States Patent [19]

Maroist

[11] Patent Number: 5,109,779

[45] Date of Patent: May 5, 1992

[54] FIRE INSULATED PARTITION

[76] Inventor: Jules Maroist, 2530 Richelieu, Beloeil, Canada, J3G 2C9

[21] Appl. No.: 758,561

[22] Filed: Sep. 12, 1991

[51] Int. Cl.[5] ..... E05G 1/00; G08B 15/02

[52] U.S. Cl. ..... 109/33; 109/29; 52/168

[58] Field of Search ..... 109/29, 31-33, 109/20, 80, 81; 52/168; 312/115

[56] References Cited

U.S. PATENT DOCUMENTS

| | | | |
|---|---|---|---|
| 5,582 | 5/1848 | Fitzgerald | 109/33 |
| 116,227 | 6/1871 | Short | 109/29 |
| 3,779,179 | 12/1973 | Marois | 109/33 |
| 4,028,854 | 6/1977 | Diggs | 52/168 |
| 4,075,798 | 2/1978 | Tazaki | 109/29 |
| 4,301,631 | 11/1981 | Tazaki | 109/29 |

*Primary Examiner*—Neill R. Wilson
*Attorney, Agent, or Firm*—Paul Marcoux

[57] ABSTRACT

A fire insulated partition including inner and outer walls to define an inner space therebetween, water pipes disposed in the inner space and having a plurality of water outlets distributed throughout the inner space to deliver water therein, a water inlet outside the partition and connected to the water pipes to introduce water therein, the water inlet also connected to a source of water, a valve to initiate water circulation in the pipes and into the inner space upon activation by a detector, and a drain to continuously drain water from the inner space after the latter has been filled therewith. A detector provided separate from the valve enables to open the valve in case a fire erupts in the vicinity of the partition. There are blade propellers at the water outlets to distribute entering water substantially against the entire interior surface of the inner and outer walls, and a motor to operate the blade propellers when the detector senses a fire. Application for example to the design of a safe, a room or the like.

4 Claims, 2 Drawing Sheets

FIRE INSULATED PARTITION

BACKGROUND OF INVENTION (a) Field of the Invention

The present invention relates to a fire insulated partition and more particularly to a safe or other types of enclosures or chambers wherein the surrounding walls include a plurality of such partitions.

(b) Description of Prior Art

In my U.S. Pat. No. 3,779,179 and its corresponding Canadian Patent No. 987,542, I disclosed a fire insulated partition and a safe which is made of a double partition and wherein a water circulation is initiated within the inner space defined by the double partition as soon as a fire starts in the vicinity of the safe, thereby providing fire insulation for the content of the safe. However, in certain cases, it is imperative that said insulation be effective just about instantaneously because of the intensity of the heat. It just so happens that in such a case, before the inner space is completely filled, the content of the safe is not adequately protected against heat. There is therefore a need to provide for a cooling of the walls of the partition immediately when a fire starts.

SUMMARY OF INVENTION

It is an object of the invention to provide a double wall partition which becomes fire insulated as soon as a fire starts in the vicinity of said partition.

It is another object of the present invention to provide a safe or other enclosure constructed with the above partition.

The invention relates to an improvement in a fire insulated partition including inner and outer walls to define an inner space therebetween, water pipes disposed in said inner spaces and having a plurality of water outlets distributed throughout said inner space to deliver water therein, a water inlet outside said partition and connected to said water pipes to introduce water therein, said water inlet also connected to a source of water, valve means to initiate water circulation in said pipes and into said inner space upon activation by a detector and means to continuously drain water from said inner space after said inner space has been filled therewith. The improvement comprises a fire detector separate from the valve means enabling to open said valve means in case a fire erupts in the vicinity of said partition, blade propellers at said water outlets to distribute entering water substantially against entire interior surface of said inner and outer walls, and means operating said blade propellers when said detector senses a fire.

The invention also concerns a safe in which the surrounding walls are made of a plurality of the above partition.

BRIEF DESCRIPTION OF DRAWINGS

The invention is illustrated but is not restricted by the annexed drawings in which.

DESCRIPTION OF PREFERRED EMBODIMENTS

Figure 1:
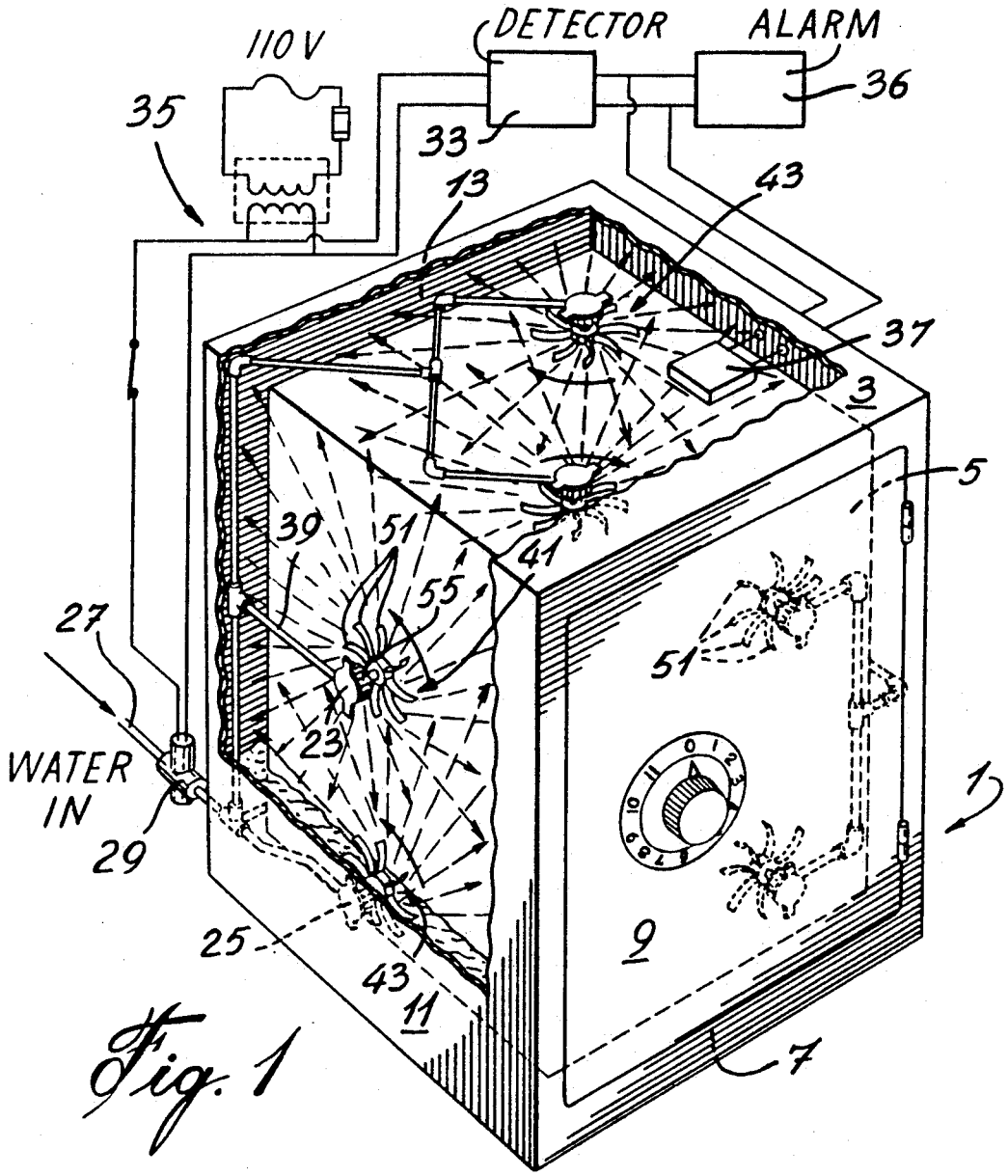
FIG. 1 is a perspective view partially broken away of a safe incorporating fire insulated partitions according to the invention.

With reference to the drawings, it will be seen that a safe 1 according to the invention is made of six fire insulated partitions 3, 5, 7, 9, 11 and 13 each containing an inner wall 15 and an outer wall 17 to define an inner space 19 therebetween. A system of water pipes 21 is disposed inside the inner space so as to provide two water outlets 23, 25 for each partition. Of course, should the need arise there may be provided a single or more than two water outlets in the inner space 19 of each partition.

The system of water pipes 21 as shown in FIG. 1 may also be modified at will the one illustrated representing only an alternative. To supply the system of water pipes 21 with the necessary water, there is provided a water inlet 27 which is outside one selected partition, such as 13 and is connected to the system of water pipes 21 in any known manner such as shown in FIG. 1 on the one hand, and to a source of water (not shown in the drawings) on the other hand. At the water inlet 27, there is provided a solenoid valve 29 which remains closed when the system is not in operation and opens in response to a signal given by the detector 31. It should be remembered that the valve 29 is kept closed in known manner by means of an electrical circuit 35, unless a fire signal is detected by the detector 31 at which time the electrical circuit will cause an immediate opening of the valve 29. Opening of the valve will also take place as a result of a power failure. This will serve to occasionally demonstrate that the insulation is operational. To prevent the valve from opening however, the system can be connected to an emergency generator (not shown).

As an interesting alternative, the safe 1 include an antitheft device 37 in the form of a vibration detector. The antitheft device 37 is coupled to the electrical circuit 35 and alarm 36. A battery (not shown) is incorporated in the antitheft device 37 to make sure that the latter is operational even in case of a power failure.

Figure 4:
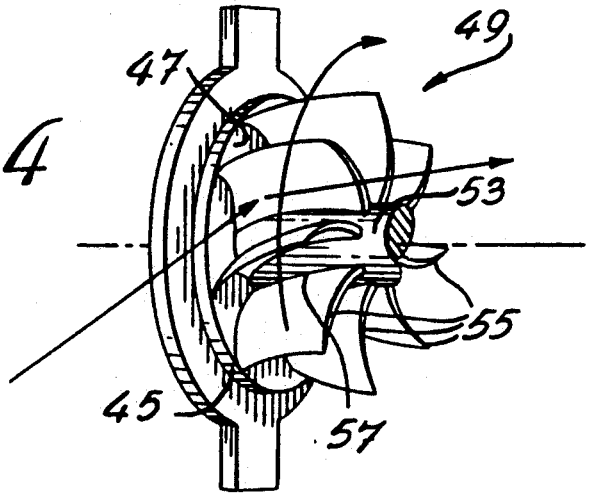
FIG. 4 is a perspective view showing the impeller portion of the water propeller.
Figures 2, 3:
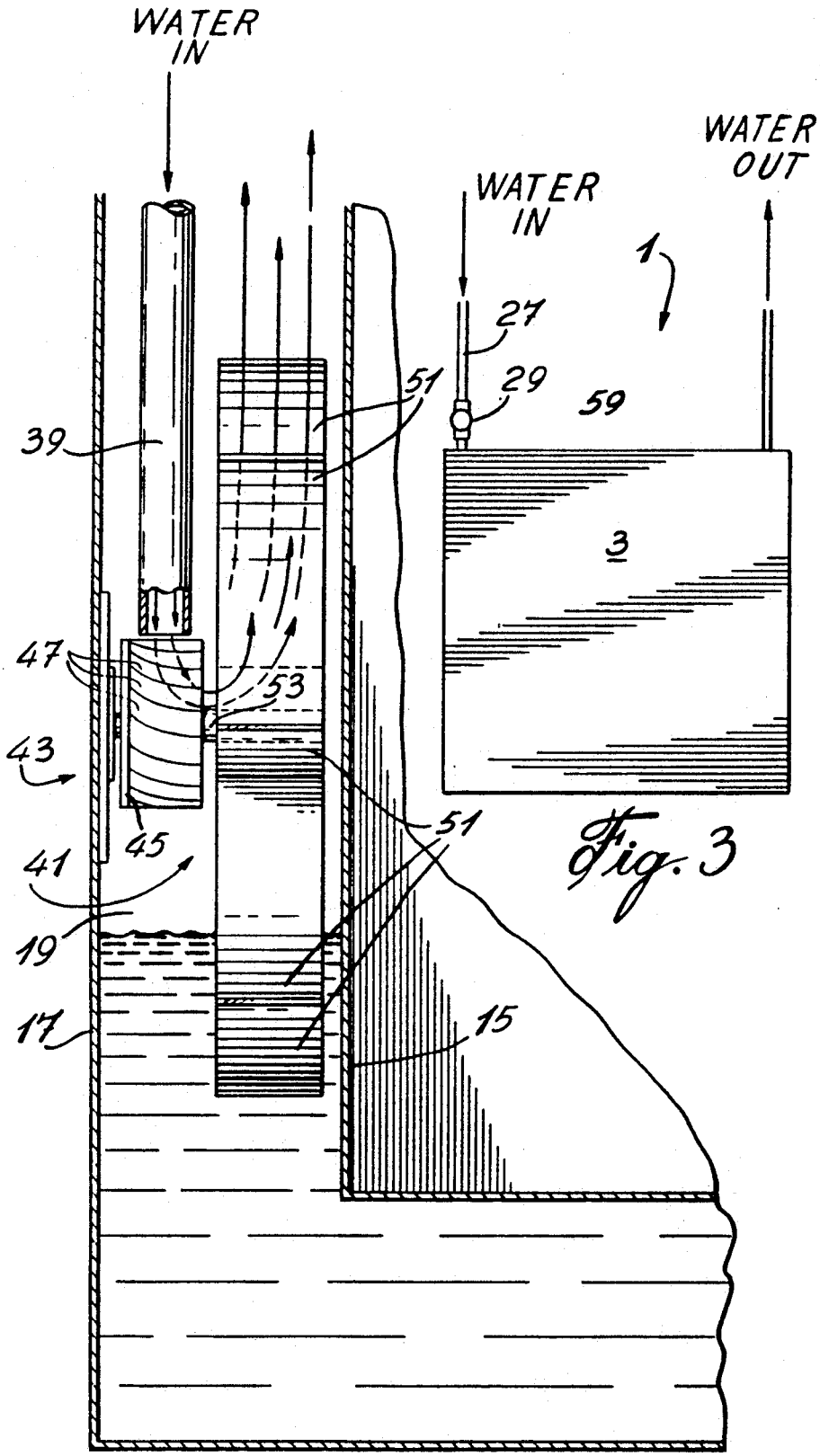
FIG. 2 is a partial cross-section view of a partition according to the invention showing the water inlet and the water propeller.
FIG. 3 is a top view of the safe showing the water inlet, drain and water outlet.

Turning now to the water outlets 23, 25 and more particularly to FIGS. 2 and 4 of the drawings, it will be seen that a pipe section 39 leads to a blade propeller 41. The blade propeller 41 consists of a rotary propeller 43 which is rotatably mounted on a housing 45 including an elbow shaped water duct 47 and a water driven mechanism 49 to operate the rotary propeller 43. Blades 51 constituting the main part of the rotary propeller 43 are mounted on a shaft portion 53 and are somewhat spoon shaped, as shown, to properly propel water against all surfaces inside the inner space.

The blade propeller 41, as indicated above, is driven by a water driven mechanism 49 which will now be described. This mechanism 49 is made of shaft 53 on which a plurality of impellers 55 (here four although this number may vary to a large extent) which are curved as shown and are fixed on the shaft 53 at an angle with respect to the axis thereof such as at 57 so as to pick up water entering through elbow shaped water duct 47 and produce a rotation of the shaft 55 which will ipso facto rotate blades 51. The rotation of the blades 51 will propel water which exits from duct 47 against the inner surfaces of the inner space 19.

The blade propeller may also be driven by a battery, electricity or another means as is well known to anyone skilled in the art. I prefer to drive the propeller with water and a preferred design has just been described.

Finally a drain 59 is provided at the bottom of a partition to drain water therefrom.

In practice, whenever the temperature in the vicinity of the safe 1 rises sufficiently to indicate that there is a danger of fire, the detector will cause the valve 29 to open and water will penetrate into the inner space 19 and will be projected against all surfaces by the blade propellers 41 to immediately provide fire insulation to the material inside the safe. In addition, the safe is protected against theft.

Finally, although this invention has been illustrated with a safe, it is of course applicable to any enclosure which is intended to be made fireproof. It is merely sufficient to design same with one or more partition as just described.

It will be realized that the use of the blades according to the invention is intended to prevent hot points inside the enclosure, thereby fully protecting sensitive materials such as microfilms or the like.

I claim:

1. In a fire insulated partition including inner and outer walls to define an inner space therebetween, water pipes disposed in said inner spaces and having a plurality of water outlets distributed throughout said inner space to deliver water therein, a water inlet outside said partition and connected to said water pipes to introduce water therein, said water inlet also connected to a source of water, valve means to initiate water circulation in said pipes and into said inner space upon activation by a detector, and means to continuously drain water from said inner space after said inner space has been filled therewith, the improvement which comprises a fire detector separate from said valve means enabling to open said valve means in case a fire erupts in the vicinity of said partition, blade propellers at said water outlets to distribute entering water substantially against entire interior surface of said inner and outer walls, and means operating said blade propellers when said detector senses a fire.

2. A safe wherein outside walls thereof are made of a plurality of fire insulated partition as in claim 1.

3. A fire insulated partition according to claim 1, wherein said blade propeller comprises a plurality of curved blades mounted on a shaft, said shaft operatively connected to a water driven mechanism, said mechanism mounted in a housing provided at one said water outlet.

4. A fire insulated partition according to claim 3, wherein said water driven mechanism comprises a plurality of impellers mounted on said shaft inside said housing, an elbow shaped duct formed inside said housing to feed water from said water pipes against said impellers thereby causing rotation of said shaft and said blade propeller.

* * * * *